US009957124B2

(12) United States Patent
Saito

(10) Patent No.: US 9,957,124 B2
(45) Date of Patent: May 1, 2018

(54) MEDIA CONVEYANCE APPARATUS

(71) Applicant: Oki Data Corporation, Tokyo (JP)

(72) Inventor: Takashi Saito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days. days.

(21) Appl. No.: 15/453,943

(22) Filed: Mar. 9, 2017

(65) Prior Publication Data

US 2017/0275112 A1 Sep. 28, 2017

(30) Foreign Application Priority Data

Mar. 24, 2016 (JP) ..... 2016-059974

(51) Int. Cl.
*B65H 7/12* (2006.01)

(52) U.S. Cl.
CPC ..... *B65H 7/125* (2013.01); *B65H 2511/12* (2013.01); *B65H 2511/13* (2013.01)

(58) Field of Classification Search
CPC ..... B65H 7/12; B65H 7/125; B65H 2553/30; B65H 2511/12; B65H 2511/13
USPC ..... 271/262, 265.04
See application file for complete search history.

(56) References Cited

U.S. PATENT DOCUMENTS 7,441,769 B2 * 10/2008 Miki ..... B65H 1/04 271/171
2008/0224389 A1 * 9/2008 Saito ..... B65H 5/24 271/256

FOREIGN PATENT DOCUMENTS

JP H10-120247 A 5/1998

* cited by examiner

*Primary Examiner* — Michael C McCullough
(74) *Attorney, Agent, or Firm* — Metrolexis Law Group, PLLC

(57) ABSTRACT

A media conveyance apparatus includes a first conveyer configured to convey media along a conveyance path, a first detector configured to detect overlap-feed of the media conveyed by the first conveyor; and a controller programmed to control operation of the first conveyor based on a detection value from the first detector, a first threshold for detection of single-feed of the media, and a second threshold for detection of overlap-feed of the media.

18 Claims, 12 Drawing Sheets

Fig. 13

| MEDIA SIZE | MEDIA LENGTH L | ADF PART 20 (OPERATION MODE M1) (DOCUMENT INTERVAL: 80 mm) | ADF PART 20R (DOCUMENT INTERVAL: 220 mm) | ADF PART 20 (OPERATION MODE M2) (DOCUMENT INTERVAL: 87.5 mm) |
|---|---|---|---|---|
| A6 PORTRAIT | 148. 5mm | 65. 6spm | 40. 7spm | 63. 6spm |
| A4 LANDSCAPE | 210mm | 50. 8spm | 34. 9spm | 50. 4spm |
| A3 | 420mm | 30. 0spm | 23. 4spm | 29. 6spm |

MEDIA CONVEYANCE APPARATUS

CROSS REFERENCE TO RELATED APPLICATIONS

This application claims priority based on 35 USC 119 from prior Japanese Patent Application No. 2016-059974 filed on Mar. 24, 2016, entitled "MEDIA CONVEYANCE APPARATUS", the entire contents of which are incorporated herein by reference.

BACKGROUND OF THE INVENTION

1. Field of the Invention

The present disclosure relates to a media conveyance apparatus configured to convey media.

2. Description of Related Art

Some image scan apparatuses have an auto document feeder (ADF) to supply a scanner part with multiple document media one by one. For example, Japanese Patent Application Publication No. Hei 10-120247 discloses an auto document feeder provided with a sensor that detects that multiple documents that are overlapped are fed at once from a document tray. In an event of such overlap-feed, the auto document feeder performs predetermined processing based on a detection result from the sensor.

SUMMARY OF THE INVENTION

An aspect of the invention is a media conveyance apparatus that includes a first conveyer configured to convey media along a conveyance path, a first detector configured to detect overlap-feed of the media conveyed by the first conveyor; and a controller programmed to control operation of the first conveyor based on a detection value from the first detector, a first threshold for detection of single-feed of the media, and a second threshold for detection of overlap-feed of the media.

BRIEF DESCRIPTION OF THE DRAWINGS

FIG. 13 is a table illustrating example characteristics of an ADF part depicted in FIG. 1.

DETAILED DESCRIPTION OF EMBODIMENTS

Figure 1:
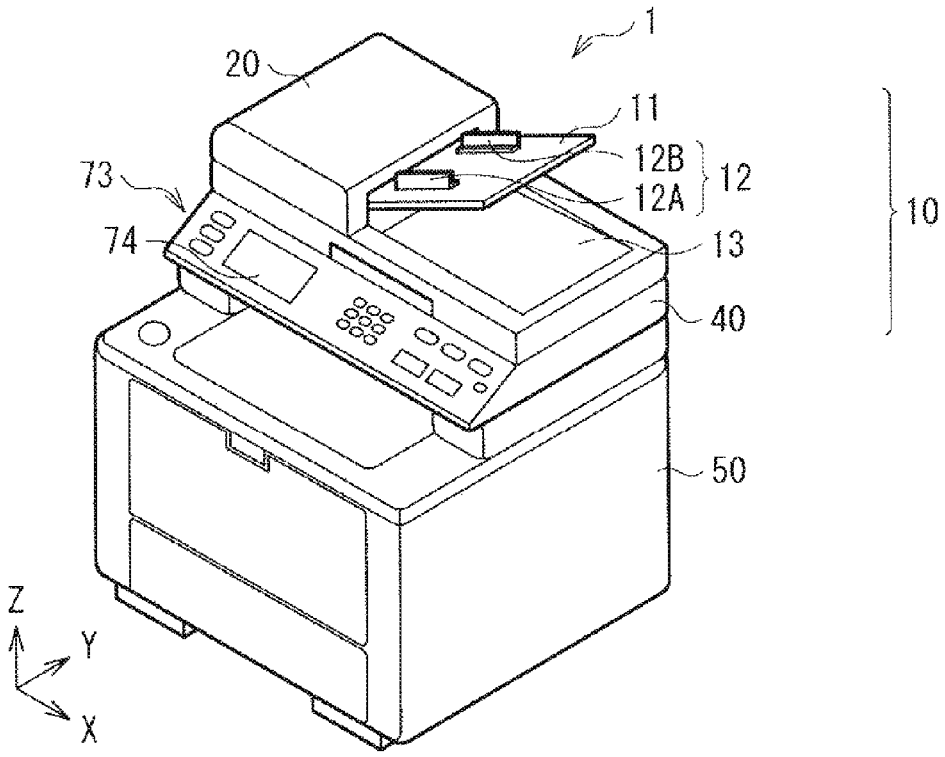
FIG. 1 is a perspective view illustrating an example configuration of a multi-function peripheral according to an embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Example Configuration

FIG. 1 illustrates an example configuration of a multi-function peripheral (MFP) including an image scan apparatus according to the embodiment of the invention. This multi-function peripheral 1 has functions as a copier, a facsimile machine, a scanner, and/or the like. Multi-function peripheral 1 includes image scan unit 10 and image formation unit 50.

Image Scan Unit 10

Image scan unit 10 scans information printed on document medium 9 such as document sheets. Image scan unit 10 includes ADF part 20 and scanner part 40. ADF part 20 conveys document media 9 one at a time and leads it to scanner part 40. Scanner part 40 scans information printed on document medium 9 led by ADF part 20. Scanner part 40 can also function as a flatbed scanner when a user lifts ADF part 20 and places document medium 9 on the upper surface of scanner part 40.

Image scan unit 10 has two operation modes: operation mode M1 and operation mode M2. Operation mode M1 is used to scan document medium 9 having width W larger than predetermined width Wth. Examples of such document medium 9 include a medium of a standard size such as A4 or B5 and a medium of a specific size set by a user. Operation mode M2 is used to scan document medium 9 having width W smaller than predetermined width Wth. Examples of such document medium 9 include a medium of a non-standard size, such as a check.

Figure 2:
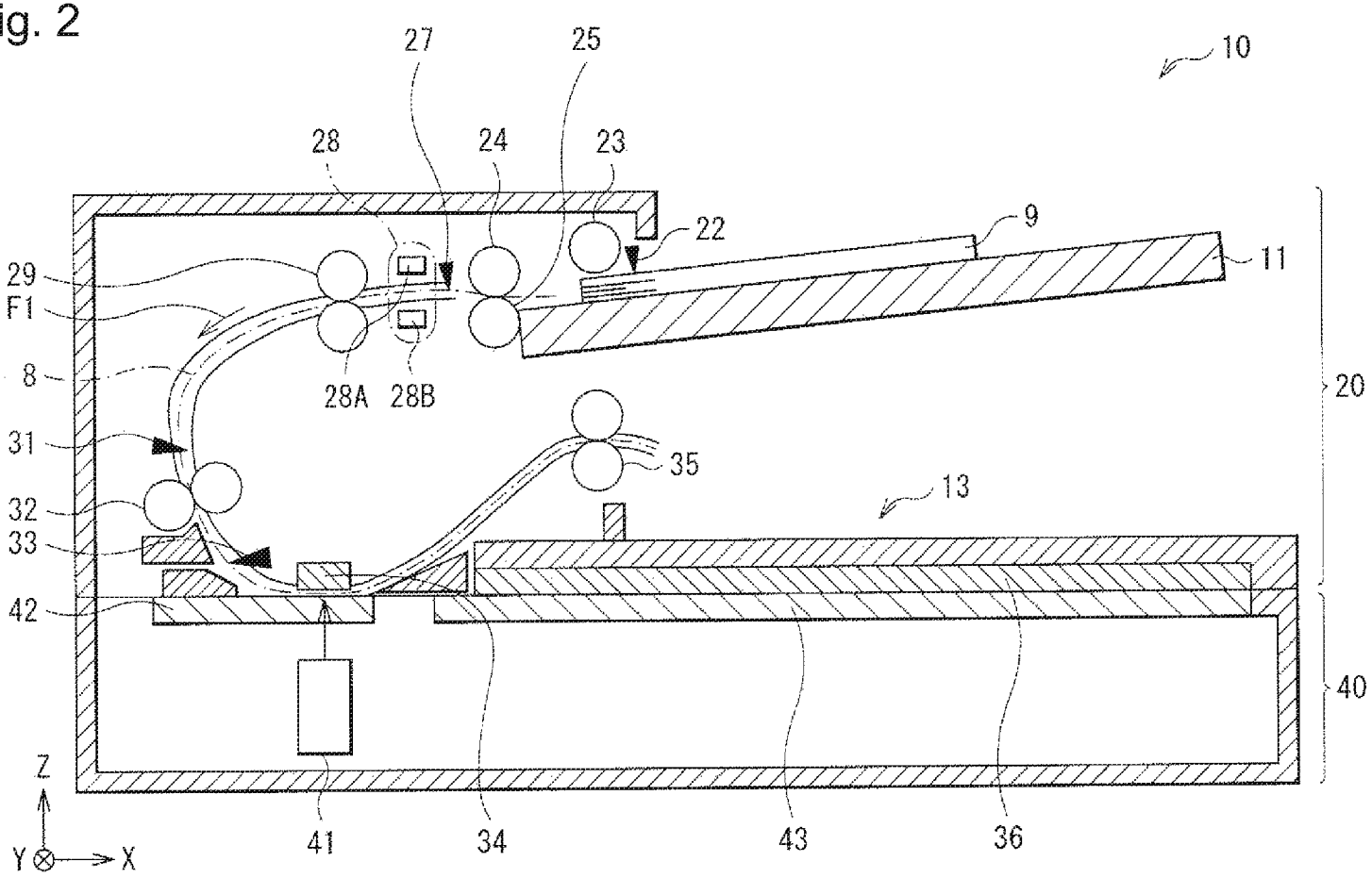
FIG. 2 is a sectional view illustrating an example configuration of an image scan unit depicted in FIG. 1.
Figure 3:
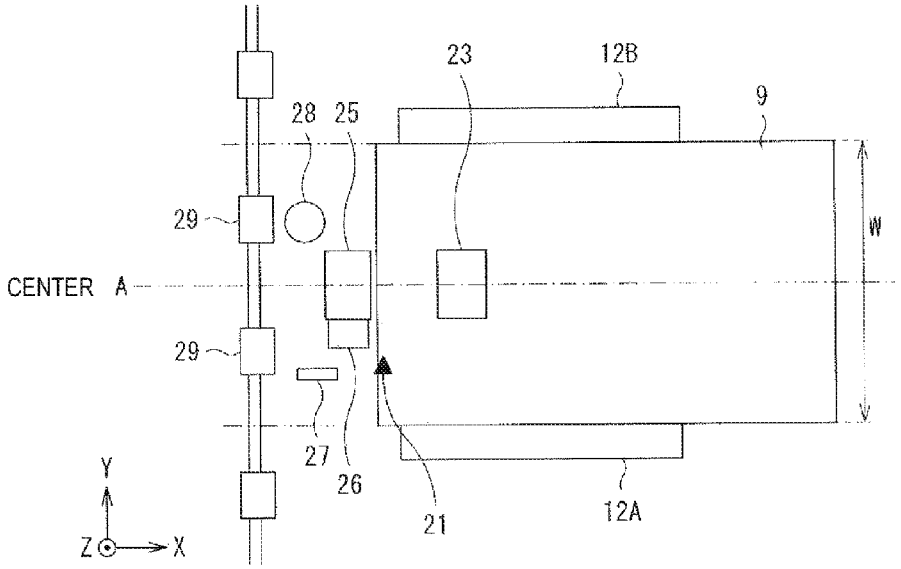
FIG. 3 is an explanatory diagram illustrating an example operation performed in operation mode M1 by the image scan unit depicted in FIG. 1.
Figure 4:
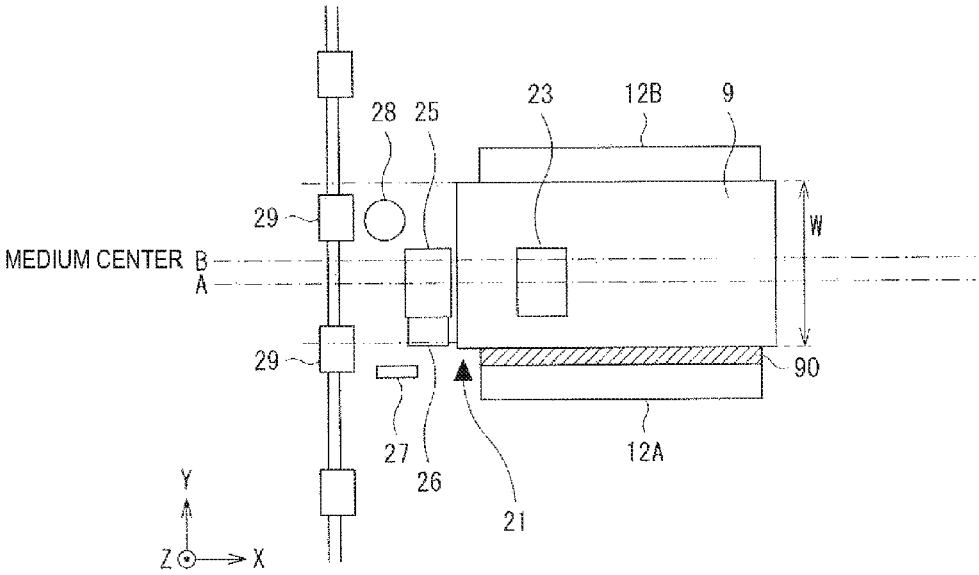
FIG. 4 is an explanatory diagram illustrating an example operation performed in operation mode M2 by the image scan unit depicted in FIG. 1.

FIG. 2 illustrates an example configuration of image scan unit 10. FIGS. 3 and 4 illustrate an example configuration of ADF part 20, FIG. 3 depicting a case where document medium 9 having width W larger than predetermined width Wth is being conveyed in operation mode M1, FIG. 4 depicting a case where document medium 9 having width W smaller than predetermined width Wth is being conveyed in operation mode M2.

ADF part 20 includes media tray 11, guide 12, guide sensor 21, media placement sensor 22, pickup roller 23, media supply roller 24, separation roller 25, torque limiter 26, media supply sensor 27, overlap-feed sensor 28, conveyance rollers 29, registration sensor 31, registration rollers 32, scan start sensor 33, media press member 34, discharge rollers 35, and media press member 36.

On media tray 11, document media 9 the information on which is to be scanned by scanner part 40 are placed.

Guide 12 guides or restricts the position of document medium 9 placed on media tray 11 so that document medium 9 may not be misaligned in a Y direction (that is, a widthwise direction of conveyance path 8 orthogonal to a conveyance direction along conveyance path 8, see FIGS. 3 and 4). Guide 12 includes guide 12A and guide 12B. Guides 12A and 12B are disposed at positions facing each other in the Y direction. Guide 12A is disposed on the side where operation part 73 and display 74 (both described later) are provided, and guide 12B is disposed on the opposite side from these parts. As depicted in FIGS. 3 and 4, guides 12A and 12B are supported by the medium tray 11 such that guides 12 A and 12B can be slid in the Y direction so that the distance between guides 12A and 12B can be changed in the Y direction with center A between guides 12A and 12B unchanged. Center A is aligned with the widthwise center of the conveyance path 8.

Guide sensor 21 (FIGS. 3 and 4) detects the distance between guide 12A and guide 12B. Guide sensor 21 thus allows detection of whether width W of document medium 9 placed on media tray 11 is smaller or larger than predetermined width Wth.

Media placement sensor 22 detects whether document medium 9 is placed on media tray 11.

Pickup roller 23 feeds document medium 9 placed on media tray 11 to conveyance path 8. Pickup roller 23 rotates when receiving power transmitted from media supply motor 81 (described later) via clutch 82 (described later).

Media supply roller 24 and separation roller 25 separate one document medium 9 from document media 9 supplied by pickup roller 23 and feed the one to conveyance path 8. Media supply roller 24 and separation roller 25 are disposed at positions facing each other with conveyance path 8 in between. Media supply roller 24 rotates when receiving power transmitted from media supply motor 81 (described later) via clutch 82 (described later). When torque larger than predetermined torque is applied to separation roller 25 in its rotational direction, separation roller 25 is caused by torque limiter 26 (described later) to be rotated by the torque. Configured as such, media supply roller 24 and separation roller 25 can separate one document medium 9 from document media 9 supplied.

Torque limiter 26 (FIGS. 3 and 4) controls rotational operation of separation roller 25. Specifically, when torque larger than predetermined torque is applied to separation roller 25 in its rotational direction, torque limiter 26 causes separation roller 25 to be rotated by the torque. In addition, when torque smaller than the predetermined torque is applied to separation roller 25 in its rotational direction, torque limiter 26 causes separation roller 25 not to rotate.

Media supply sensor 27 detects passage of document medium 9 in operation mode M1. As depicted in FIGS. 3 and 4, media supply sensor 27 is disposed at a position displaced from media supply roller 24 and separation roller 25 in the Y direction and slightly downstream of media supply roller 24 and separation roller 25 on conveyance path 8. In operation mode M1, media supply sensor 27 is used to control the operation of conveying document medium 9. Specifically, ADF part 20 stops the rotational operations of pickup roller 23 and media supply roller 24 when, for example, document medium 9 is conveyed a predetermined distance after media supply sensor 27 detects the leading edge of document medium 9. For example, this predetermined distance is set to be longer than the distance between media supply sensor 27 and conveyance rollers 29. ADF part 20 resumes the rotational operations of pickup roller 23 and media supply roller 24 when, for example, media supply sensor 27 detects the tailing edge of document medium 9. ADF part 20 thus allows multiple document media 9 placed on media tray 11 to be sequentially conveyed one at a time along conveyance path 8 with a predetermined interval between document media 9.

Overlap-feed sensor 28 detects overlap-feed of document media 9 in operation modes M1 and M2. Overlap-feed sensor 28 is also capable of detecting passage of document medium 9 in operation mode M2. As depicted in FIGS. 3 and 4, overlap-feed sensor 28 is disposed at a position displaced from media supply roller 24 and separation roller 25 in the Y direction and slightly downstream of media supply roller 24 and separation roller 25 on conveyance path 8. In this example, media supply sensor 27, the set of media supply roller 24 and separation roller 25, and overlap-feed sensor 28 are arranged in this order in the Y direction. Thus, compared to an example case where media supply sensor 27, the set of media supply roller 24 and separation roller 25, and overlap-feed sensor 28 are aligned in conveyance direction F1 (FIG. 2) along conveyance path 8, the space in ADF part 20 containing these sensors and rollers can be reduced in length in conveyance direction F1. Such ADF part 20 in turn enables reduction in apparatus size.

As depicted in FIG. 2, overlap-feed sensor 28 includes transmitter 28A and receiver 28B. Transmitter 28A and receiver 28B are disposed at positions facing each other with conveyance path 8 in between. Transmitter 28A transmits ultrasonic waves at predetermined intervals, and receiver 28B receives the ultrasonic waves transmitted by transmitter 28A. The amplitude of the ultrasonic waves received by receiver 28B varies depending on whether document medium 9 is, and how many document media 9 are, on conveyance path 8 between transmitter 28A and receiver 28B. Specifically, as is described later, for example, when one document medium 9 is on conveyance path 8, ultrasonic waves received by receiver 28B have smaller amplitude than those received when no document medium 9 is on conveyance path 8. In addition, for example, when two document media 9 are on conveyance path 8, ultrasonic waves received by receiver 28B have smaller amplitude than those received when one document medium 9 is on conveyance path 8. Overlap-feed sensor 28 generates detection signal DET having a voltage corresponding to the amplitude of ultrasonic waves received by receiver 28B and outputs this detection signal DET.

Overlap-feed sensor 28 is used to control the operation of conveying document medium 9. Specifically, when overlap-feed sensor 28 detects overlap-feed of document media 9 in operation modes M1 and M2, ADF part 20 stops the conveyance operation and notifies a user of the overlap-feed using, for example, display 74 or a notification device. The notification device may include a display, a speaker, and the like. In addition, when overlap-feed sensor 28 detects passage of document medium 9 in operation mode M2, ADF part 20 controls the conveyance operation as in the case where media supply sensor 27 detects passage of document medium 9 in operation mode M1. Specifically, ADF part 20 stops the rotational operations of pickup roller 23 and media supply roller 24 when, for example, document medium 9 is conveyed a predetermined distance after overlap-feed sensor 28 detects the leading edge of document medium 9. Then, ADF part 20 resumes the rotational operations of pickup roller 23 and media supply roller 24 when, for example, document medium 9 is conveyed a predetermined distance after overlap-feed sensor 28 detects the tailing edge of document medium 9.

Conveyance rollers 29 are paired rollers disposed at positions sandwiching conveyance path 8, and convey document medium 9 along conveyance path 8. Conveyance rollers 29 rotate when receiving power transmitted from media supply motor 81 (described later).

Registration sensor 31 detects passage of document medium 9. Registration sensor 31 is provided upstream of registration rollers 32 on conveyance path 8.

Registration rollers 32 are paired rollers disposed at positions sandwiching conveyance path 8, and correct skew of document medium 9 passing registration rollers 32 along conveyance path 8. Registration rollers 32 rotate when receiving power transmitted from conveyance motor 83 (described later) via clutch 84 (described later). ADF part 20 starts rotational operation of registration rollers 32 when document medium 9 is conveyed a predetermined distance after registration sensor 31 detects the leading edge of document medium 9. For example, this predetermined distance is set to be longer than the distance between registration sensor 31 and registration rollers 32. Thus, in ADF part 20, skew of document medium 9 is corrected before document medium 9 is led to scanner part 40.

Scan start sensor 33 detects passage of document medium 9. Scan start sensor 33 is provided upstream of a location aligned with imaging device 41 on conveyance path 8. Scan start sensor 33 is used to determine the timing for imaging device 41 to start its scanning operation.

Media press member 34 leads document medium 9 which has been conveyed along conveyance path 8, to the surface of transparent plate 42 (described later) of scanner part 40.

Discharge rollers 35 are paired rollers disposed at positions sandwiching conveyance path 8, and lead document medium 9 information on which has been scanned by scanner part 40 to media discharge part 13. Discharge rollers 35 rotate when receiving power transmitted from conveyance motor 83 (described later).

Media press member 36 is used when scanner part 40 operates as a flatbed scanner, to press document medium 9 placed on transparent plate 43 (described later) of scanner part 40 against transparent plate 43.

As depicted in FIG. 2, scanner part 40 includes imaging device 41 or an image pickup device, transparent plate 42, and transparent plate 43.

Imaging device 41 scans information printed on document medium 9, and is configured with, for example, a contact image sensor (CIS) unit. Imaging device 41 is movable in an X direction (the lateral direction in FIG. 2). To scan information printed on document medium 9 led by ADF part 20, imaging device 41 performs scanning operation after moving to a position aligned with media press member 34. When scanner part 40 operates as a flatbed scanner, imaging device 41 performs scanning operation while slowly moving within the area covered by media press member 36. Imaging device 41 then outputs data scanned from document medium 9, as scanned data DR.

Transparent plate 42 is disposed at a position aligned with media press member 34 of ADF part 20. Imaging device 41 scans, through this transparent plate 42, information printed on document medium 9 led by ADF part 20.

Transparent plate 43 is disposed at a position aligned with media press member 36 of ADF part 20. When scanner part 40 operates as a flatbed scanner, imaging device 41 scans, through this transparent plate 43, information printed on document medium 9 placed by a user.

As depicted in FIGS. 3 and 4, in ADF part 20, media supply sensor 27, the set of media supply roller 24 and separation roller 25, and overlap-feed sensor 28 are arranged in this order in the Y direction. Thus, when document medium 9 having small width W passes media supply sensor 27 and overlap-feed sensor 28, document medium 9 may not be sufficiently covered by the detection areas of these sensors. Thus, in ADF part 20, when width W of document medium 9 is smaller than predetermined width Wth, attachment 90 is attached to the inside of guide 12A in the widthwise direction y of the conveyance path 8 as depicted in FIG. 4. Attachment 90 that is attached to guide 12A restricts the position of document medium 9 in terms of Y-direction misalignment and pushes document medium 9 placed on media tray 11 toward guide 12B. When width W of document medium 9 is smaller than predetermined width Wth, ADF part 20 operates under operation mode M2. In operation mode M2, overlap-feed sensor 28 detects passage of document medium 9 in place of media supply sensor 27. Thereby, in ADF part 20, document medium 9 can be sufficiently covered by the detection area of overlap-feed sensor 28, so that overlap-feed sensor 28 can detect passage of document medium 9 and overlap-feed of document media 9 even when document medium 9 has small width W. Hence, ADF part 20 is capable of stable conveyance of document medium 9.

Figure 5A:
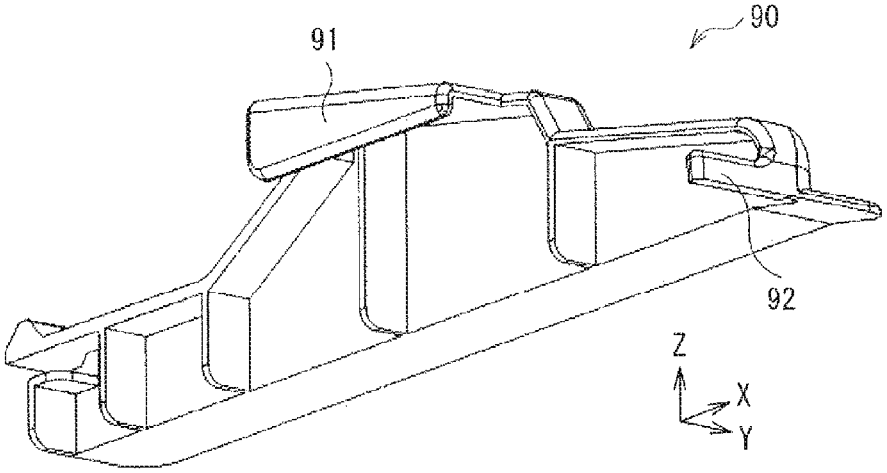
FIG. 5A is a perspective view illustrating an example configuration of an attachment depicted in FIG. 4.
Figure 5B:
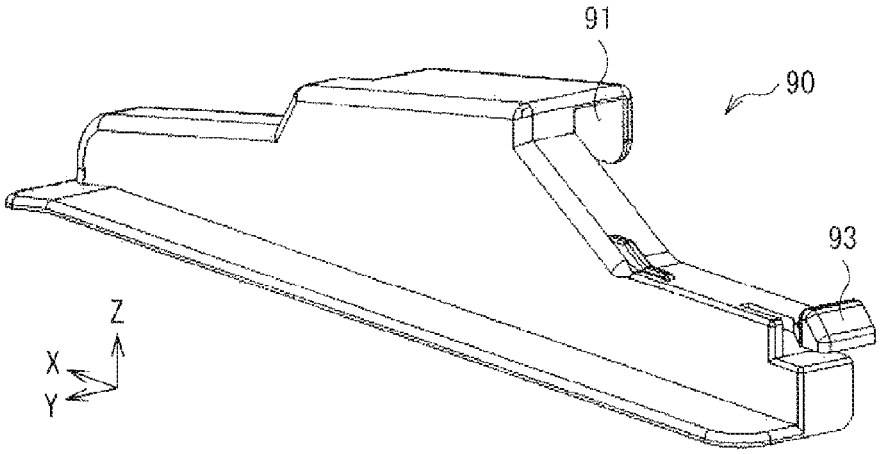
FIG. 5B is another perspective view illustrating the example configuration of the attachment depicted in FIG. 4.
Figure 6:
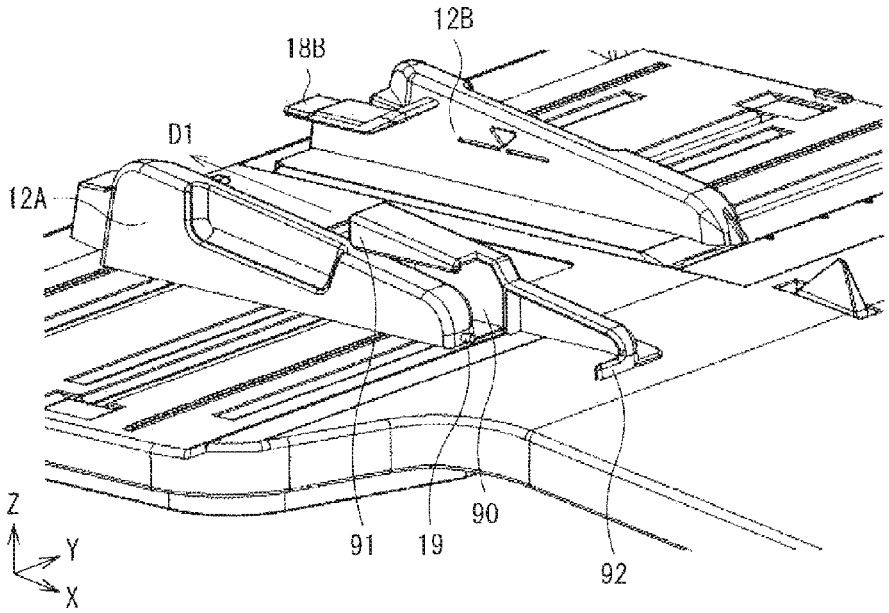
FIG. 6 is a perspective view illustrating an example of how the attachment depicted in FIGS. 5A and 5B is attached.
Figure 7:
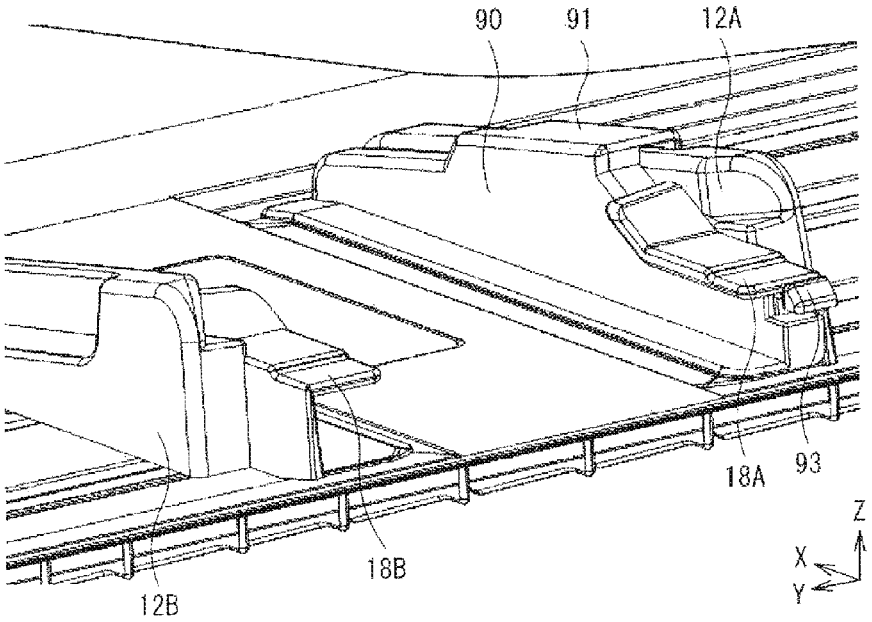
FIG. 7 is another perspective view illustrating the example of how the attachment depicted in FIGS. 5A and 5B is attached.

FIGS. 5A and 5B illustrate an example configuration of attachment 90. FIG. 6 illustrates attachment 90 right before being attached to guide 12A, and FIG. 7 illustrates attachment 90 attached to guide 12A. In this example, as depicted in FIG. 6, attachment 90 is attached to guide 12A by being slid in a direction opposite from the X direction (a slide direction D1).

As depicted in FIGS. 6 and 7, guide 12A includes a body thereof, presser 18A projected from the body toward the other guide 12B, and attachment sensor 19. Guide 12B has a body thereof and presser 18B projected from the body toward the other guide 12A. The bodies of guides 12A and 12B are parallel to and faces each other. Pressers 18A and 18B has a place shape and provided at the substantially same height from the document placement surface of media tray 11. Pressers 18A and 18B press document medium 9 placed on media tray 11 so that document medium 9 may not curve upwards when document medium 9 is led to conveyance path 8. Attachment sensor 19 detects whether attachment 90 is attached to guide 12A, and in this example, configured using a mechanical switch. Attachment sensor 19 is, in this example, placed at an end portion of guide 12A in a direction opposite from slide direction D1.

Attachment 90 includes a body thereof, engagement portion 91, protrusion portion 92, and fixation portion 93 which are protruded from the body of the attachment 90.

Engagement portion 91 engages with guide 12A. Specifically, as depicted in FIG. 6, engagement portion 91 engages with an upper portion of guide 12A when attachment 90 is slid in slide direction D1. In this example, the upper surface of guide 12A is slanted in such a manner that guide 12A becomes taller in a direction opposite from the X direction.

Then, a surface of engagement portion 91 of attachment 90 which comes into contact with guide 12A is also slanted to coincide with the slant of the upper surface of guide 12A. Thus, engagement portion 91 engages with the upper portion of guide 12A when attachment 90 is slid in slide direction D1 to a predetermined position.

Protrusion portion 92 is provided at an end portion of attachment 90 in a direction opposite from slide direction D1. Specifically, protrusion portion 92 is provided at a portion of attachment 90 which is to be located at the same position as attachment sensor 19 when attachment 90 is attached to guide 12A. Thus, protrusion portion 92 comes into contact with attachment sensor 19 of guide 12A when attachment 90 is slid in slide direction D1. Thereby, attachment sensor 19 detects that attachment 90 is attached.

Protrusion portion 92 also functions as an incorrect attachment prevention member. Specifically, when, for example, a user tries to attach attachment 90 to guide 12B instead of guide 12A by mistake, protrusion portion 92 interferes with a side surface of guide 12B. ADF part 20 thus ensures that attachment 90 cannot be attached to guide 12B.

Fixation portion 93 fixes attachment 90 to guide 12A. Fixation portion 93 can bow in a Z direction. As depicted in FIG. 6, when a user starts sliding attachment 90 in slide direction D1, fixation portion 93 is inserted into space below presser 18A of guide 12A, bowing downward. Then, as depicted in FIG. 7, when the user slides attachment 90 further, fixation portion 93 exits the space below presser 18A and snaps up, fixing attachment 90 to guide 12A.

As described, the body of attachment 90 is attached to the inside of the body of guide 12A in the widthwise direction to enable ADF part 20 to perform stable conveyance of document medium 9 even when document medium 9 has small width W. In addition, out of guides 12A and 12B, attachment 90 is attached to guide 12A which is closer to operation part 73 and display 74 (both described later). This makes it easy for a user to attach attachment 90.

Image Formation Unit 50

Figure 8:
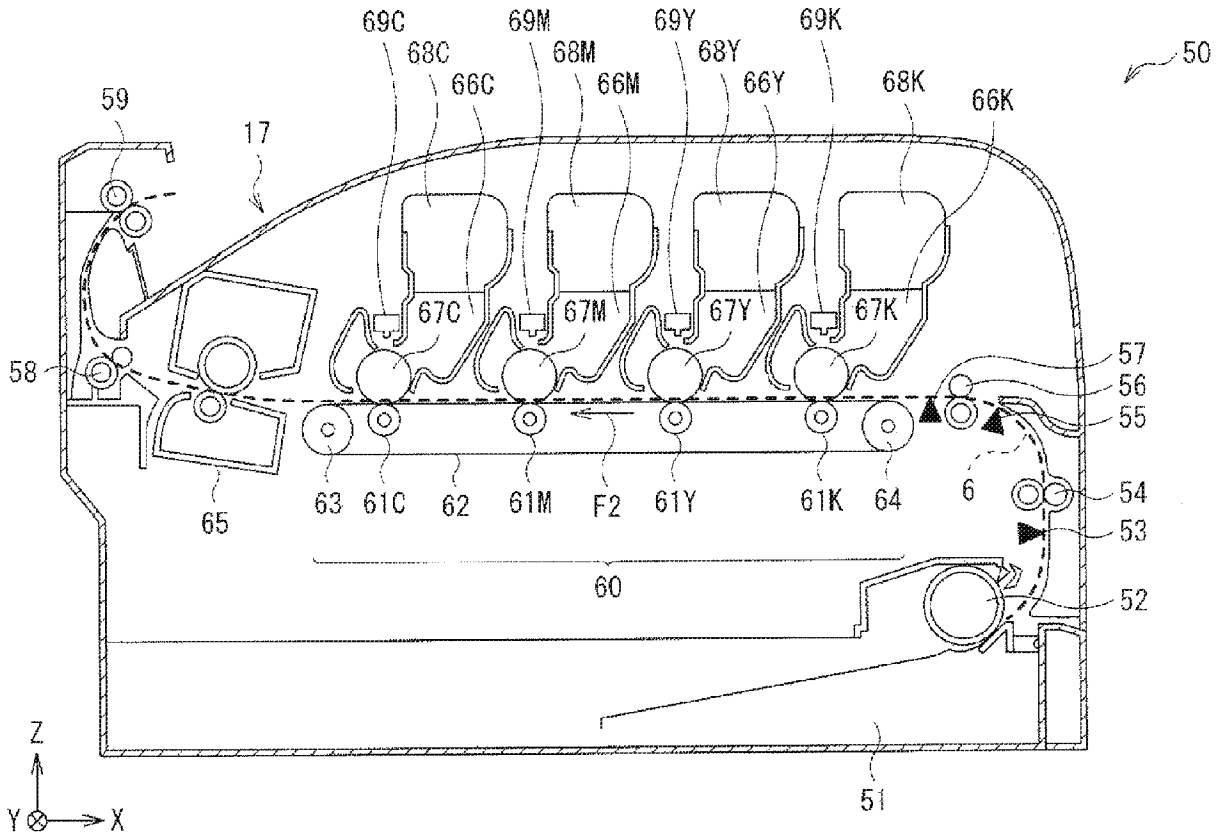
FIG. 8 is a sectional view illustrating an example configuration of an image formation unit depicted in FIG. 1.

FIG. 8 illustrates an example configuration of image formation unit 50. In this example, image formation unit 50 xerographically forms an image on recording medium 7. Image formation unit 50 includes media supply cassette 51, media supply roller 52, sensor 53, registration rollers 54, sensor 55, conveyance rollers 56, sensor 57, four image drum (ID) units 66 (66K, 66Y, 66M, and 66C), four toner reservoirs 68 (68K, 68Y, 68M, 68C), four exposure heads 69 (69K, 69Y, 69M, 69C), transfer unit 60, fuser part 65, conveyance rollers 58, and discharge rollers 59.

In media supply cassette 51, recording media 7 onto which an image is to be formed is placed.

Media supply roller 52 picks up an uppermost one of recording media 7 placed in media supply cassette 51 one at a time, and feeds picked-up recording medium 7 to conveyance path 6. Sensor 53 detects passage of recording medium 7. Registration rollers 54 are paired rollers disposed at positions sandwiching conveyance path 6, and correct skew of recording medium 7 passing on conveyance path 6. Sensor 55 detects passage of recording medium 7. Conveyance rollers 56 are paired rollers disposed at positions sandwiching conveyance path 6, and convey recording medium 7 along conveyance path 6, leading recording medium 7 to ID units 66. Sensor 57 is used to determine the timing for ID units 66 and exposure heads 69 to start image formation.

Four ID units 66 each form a toner image. Specifically, ID unit 66K forms a black toner image, ID unit 66Y forms a yellow toner image, ID unit 66M forms a magenta toner image, and ID unit 66C forms a cyan toner image. In this example, ID units 66K, 66Y, 66M, and 66C are arranged in this order in conveyance direction F2 for recording medium 7. ID units 66 may be detachable.

Each ID unit 66 includes photosensitive drum 67. Photosensitive drum 67 carries an electrostatic latent image on its surface (superficial portion). Specifically, an electrostatic latent image is formed on photosensitive drum 67K of ID unit 66K when photosensitive drum 67K is exposed to light by exposure head 69K, an electrostatic latent image is formed on photosensitive drum 67Y of ID unit 66Y when photosensitive drum 67Y is exposed to light by exposure head 69Y, an electrostatic latent image is formed on photosensitive drum 67M of ID unit 66M when photosensitive drum 67M is exposed to light by exposure head 69M, and an electrostatic latent image is formed on photosensitive drum 67C of ID unit 66C when photosensitive drum 67C is exposed to light by exposure head 69C. On each photosensitive drum 67, a toner image is formed based on the electrostatic latent image.

Four toner reservoirs 68 each contain toner. Specifically, toner reservoir 68K contains black toner and can be attached to and detached from ID unit 66K, toner reservoir 68Y contains yellow toner and can be attached to and detached from ID unit 66Y, toner reservoir 68M contains magenta toner and can be attached to and detached from ID unit 66M, and toner reservoir 68C contains cyan toner and can be attached to and detached from ID unit 66C.

Four exposure heads 69 irradiate corresponding photosensitive drums 67 with light, and are configured with, for example, light emitting diodes (LED). Specifically, exposure head 69K irradiates photosensitive drum 67K with light, exposure head 69Y irradiates photosensitive drum 67Y with light, exposure head 69M irradiates photosensitive drum 67M with light, and exposure head 69C irradiates photosensitive drum 67C with light. Irradiation by exposure heads 69 allows electrostatic latent images to be formed on photosensitive drums 67.

Transfer unit 60 transfers toner images formed by four ID units 66 onto a transfer surface of recording medium 7. Transfer unit 60 includes four transfer rollers 61 (61K, 61Y, 61M, 61C), transfer belt 62, driver roller 63, and driven roller 64.

Transfer roller 61K is disposed at a position facing photosensitive drum 67K with conveyance path 6 in between, transfer roller 61Y is disposed at a position facing photosensitive drum 67Y with conveyance path 6 in between, transfer roller 61M is disposed at a position facing photosensitive drum 67M with conveyance path 6 in between, and transfer roller 61C is disposed at a position facing photosensitive drum 67C with conveyance path 6 in between.

Transfer belt 62 conveys recording medium 7 along conveyance path 6. Transfer belt 62 is looped around and tensioned by driver roller 63 and driven roller 64. Transfer belt 62 circulates in conveyance direction F2 as driver roller 63 rotates.

Driver roller 63 causes transfer belt 62 to circulate. In this example, driver roller 63 is disposed downstream of four ID units 66 in conveyance direction F2. Driven roller 64 rotates by following the circulation of transfer belt 62. In this example, driven roller 64 is disposed upstream of four ID units 66 in conveyance direction F2.

Fuser part 65 applies heat and pressure to recording medium 7 so that toner images transferred on recording medium 7 may be fused and fixed onto recording medium 7.

Conveyance rollers 58 are paired rollers disposed at positions sandwiching conveyance path 6, and convey, along conveyance path 6, recording medium 7 onto which toner images have been fused and fixed. Discharge rollers 59 are paired rollers disposed at positions sandwiching conveyance path 6, and discharge recording medium 7 conveyed by conveyance rollers 58, to stacker 17.

Control Mechanism in Multi-Function Peripheral 1

Figure 9:
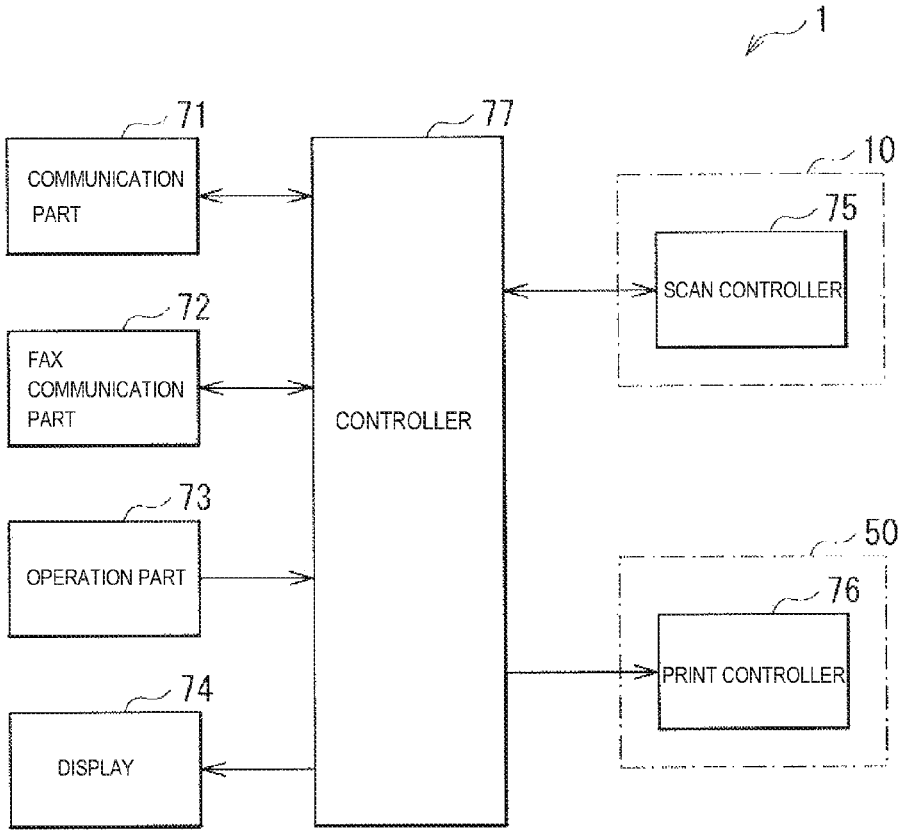
FIG. 9 is a block diagram illustrating an example control mechanism in the multi-function peripheral depicted in FIG. 1.

FIG. 9 illustrates an example control mechanism in multi-function peripheral 1. Multi-function peripheral 1 includes communication part 71, FAX communication part 72, operation part 73, display 74, scan controller 75, print controller 76, and controller 77.

Communication part 71, in this example, communicates with a host computer to receive print data from the host computer. Communication part 71 may be connected to the host computer by a universal serial bus (USB) or via a local area network (LAN). FAX communication part 72 exchanges data with a communication partner using a telephone line. Operation part 73 receives operational inputs by a user, and configured with, for example, a touch panel and/or buttons. Display 74 displays the status of multi-function peripheral 1 and the like, and is configured with, for example, a liquid crystal display. Scan controller 75 controls the operations of the members of image scan unit 10. Print controller 76 controls the operations of the members of image formation unit 50.

Controller 77 controls the operations of these blocks. For example, when a user instructs a copy job using operation part 73, controller 77 instructs scan controller 75 to scan information printed on document medium 9, and instructs print controller 76 to print the scanned image. For example, when a user instructs a FAX transmission job using operation part 73, controller 77 instructs scan controller 75 to scan information printed on document medium 9, and instructs FAX communication part 72 to transmit the scanned image to a communication partner. For example, when a user instructs a scan job using operation part 73, controller 77 instructs scan controller 75 to scan information printed on document medium 9, and instructs communication part 71 to transmit the scanned image to, for example, the host computer. For example, when a user instructs a scan job from the host computer, controller 77 instructs scan controller 75 to scan information printed on document medium 9 and instructs communication part 71 to transmit the scanned image to, for example, the host computer. Note that controller 77, print controller, and scan controller 75 comprise: one or more memories; and one or more processors or CPUs configured to execute one or more computer programs stored in the memories such that controllers 77, 76, and 75 performs various operations.

Figure 10:
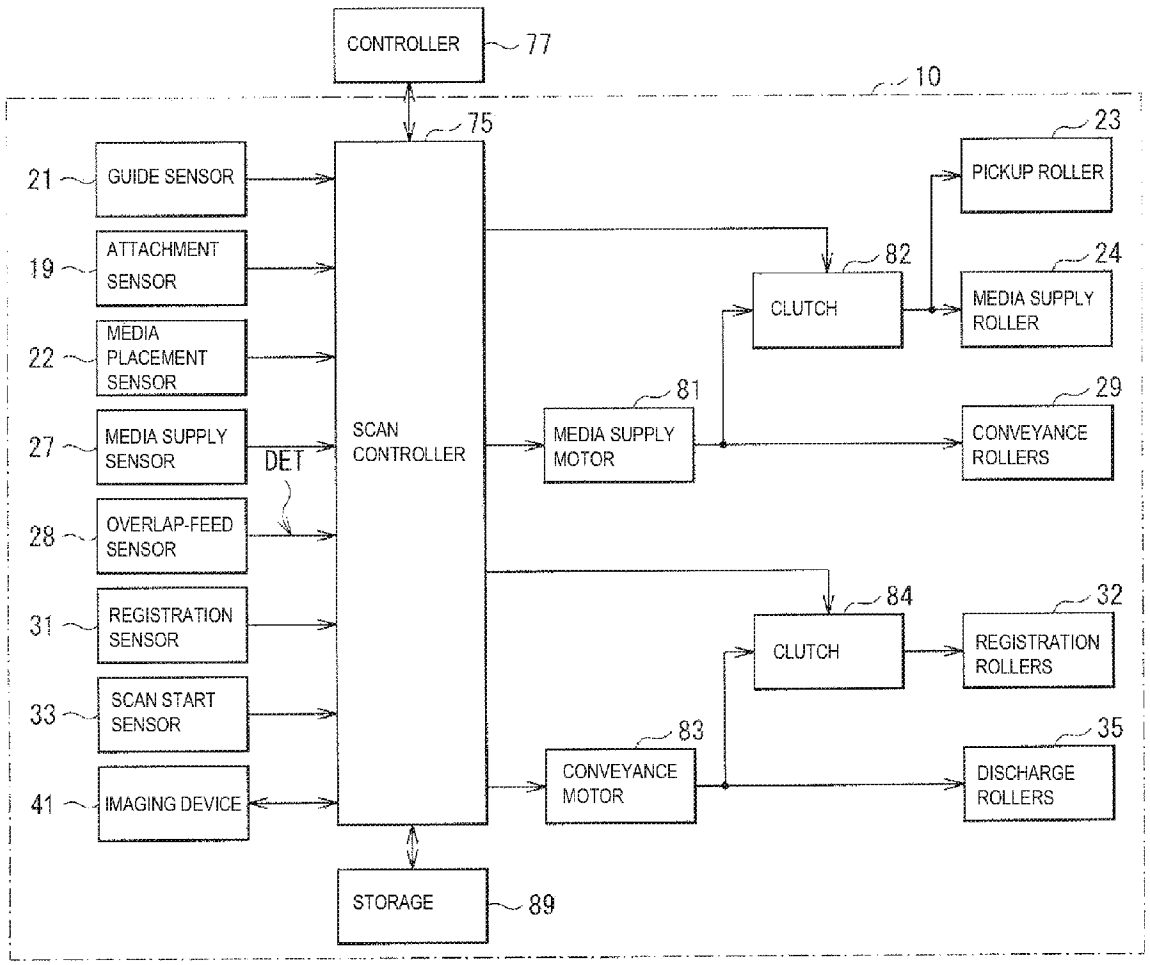
FIG. 10 is a block diagram illustrating an example control mechanism in the image scan unit depicted in FIG. 2.

FIG. 10 illustrates an example control mechanism in image scan unit 10. Image scan unit 10 includes media supply motor 81, clutch 82, conveyance motor 83, clutch 84, and storage 89.

Based on an instruction from scan controller 75, media supply motor 81 generates power to be supplied to pickup roller 23, media supply roller 24, and conveyance rollers 29. Based on an instruction from scan controller 75, clutch 82 allows or blocks transmission of the power generated by media supply motor 81 to pickup roller 23 and media supply roller 24.

Based on an instruction from scan controller 75, conveyance motor 83 generates power to be supplied to registration rollers 32 and discharge rollers 35. Based on an instruction from scan controller 75, clutch 84 allows or blocks transmission of the power generated by conveyance motor 83 to registration rollers 32.

Storage 89 or a memory stores information. Specific examples of information stored in storage 89 include various pieces of settings information for image scan unit 10 and scanned data DR obtained when image scan unit 10 scans document medium 9. The settings information stored in storage 89 includes, for example, information on predetermined width Wth.

When instructed by controller 77 to scan information printed on document medium 9 using ADF part 20, scan controller 75 selects either operation mode M1 or operation mode M2 based on width W of document medium 9. Specifically, for example, when a user instructs multi-function peripheral 1 to scan document medium 9 of a non-standard size, the user inputs the size (e.g., width W) of document medium 9 using operation part 73 or a user interface of the host computer. Scan controller 75 is notified of this size information via controller 77. Scan controller 75 determines the operation mode based on width W of document medium 9 thus acquired and predetermined width Wth stored in storage 89. Specifically, scan controller 75 sets the operation mode to operation mode M1 when width W of document medium 9 is larger than predetermined width Wth and to operation mode M2 when width W of document medium 9 is smaller than predetermined width Wth. Scan controller 75 may alternatively determine the operation mode based on a detection result from guide sensor 21. When the operation mode is set to operation mode M2, scan controller 75 checks whether attachment 90 is attached, based on a detection result from attachment sensor 19. If attachment 90 is not attached, scan controller 75 instructs controller 77 to display a message on display 74, prompting the user to attach attachment 90.

Scan controller 75 moves imaging device 41 or an image pickup device to a position aligned with media press member 34 of ADF part 20. Scan controller 75 actuates media supply motor 81 and conveyance motor 83 to start the operation of conveying document medium 9. In operation mode M1 for example, when media supply sensor 27 detects passage of document medium 9, scan controller 75 controls the operation of clutch 82 based on the detection result, to thereby control the operations of pickup roller 23 and media supply roller 24. In operation mode M2, when overlap-feed sensor 28 detects passage of document medium 9, scan controller 75 controls the operation of clutch 82 based on the detection result, to thereby control the operations of pickup roller 23 and media supply roller 24. If overlap-feed sensor 28 detects overlap-feed, scan controller 75 instructs controller 77 to stop the operations of media supply motor 81 and conveyance motor 83 and display a message on display 74 to notify the user of the overlap-feed.

Based on a detection result from registration sensor 31, scan controller 75 controls the operation of clutch 84 to correct skew of document medium 9. Then, based on a detection result from scan start sensor 33, scan controller 75 causes imaging device 41 to start its scanning operation. Scan controller 75 then receives scanned data DR from imaging device 41, and stores scanned data DR in storage 89 temporarily. Scan controller 75 then supplies controller 77 with scanned data DR stored in storage 89.

When instructed by controller 77 to cause scanner part 40 to operate as a flatbed scanner and scan information printed on document medium 9, scan controller 75 moves imaging device 41 to a position aligned with an end portion of media press member 36 of ADF part 20. Scan controller 75 then causes imaging device 41 to perform its scanning operation while moving slowly within the area covered by media press member 36. Scan controller 75 then receives scanned data DR from imaging device 41, and stores scanned data DR in storage 89 temporarily. Scan controller 75 supplies controller 77 with scanned data DR stored in storage 89.

Scan controller 75 may be configured by hardware, or by software such as firmware.

Herein, pickup roller 23 is a specific example of the "first feeder" of the present disclosure. Media supply roller 24 and separation roller 25 are a specific example of the "second feeder" of the present disclosure. Overlap-feed sensor 28 is a specific example of the "first detector" of the present disclosure. Media supply sensor 27 is a specific example of the "second detector" of the present disclosure. Guide sensor 21 is a specific example of the "third detector" of the present disclosure. Scan controller 75 and controller 77 area specific example of the "controller" of the present disclosure. Operation mode M1 is a specific example of the "first operation mode" of the present disclosure. Operation mode M2 is a specific example of the "second operation mode" of the present disclosure. Media tray 11 is a specific example of the "placement part" of the present disclosure. Guide 12A is a specific example of the "first restrict member" of the present disclosure. Guide 12B is a specific example of the "second restrict member" of the present disclosure. Attachment 90 is a specific example of the "third restrict member" of the present disclosure. Protrusion portion 92 is a specific example of the "engagement prevention part" of the present disclosure.

Operations and Effects

Next, a description is given of the operations and effects of multi-function peripheral 1 of the embodiment.

Outline of Overall Operation

First, the overall operation of multi-function peripheral 1 is outlined with reference to FIGS. 1, 2, and 8 to 10. In an example described below, a user instructs a copy job using operation part 73. First, controller 77 (FIG. 9) instructs scan controller 75 of image scan unit 10 to scan information printed on document medium 9.

In a case where ADF part 20 is used for the scanning of information printed on document medium 9, scan controller 75 (FIG. 10) of image scan unit 10 first selects either operation mode M1 or M2 based on width W of document medium 9 and predetermined width Wth stored in storage 89. Specifically, scan controller 75 sets the operation mode to operation mode M1 when width W of document medium 9 is larger than predetermined width Wth, and to operation mode M2 when width W of document medium 9 is smaller than predetermined width Wth. When the operation mode is set to operation mode M2, scan controller 75 checks whether attachment 90 is attached, based on a detection result from attachment sensor 19. If attachment 90 is not attached, scan controller 75 instructs display 74 to display a message prompting the user to attach attachment 90.

Then, scan controller 75 starts the operation of conveying document medium 9 by moving imaging device 41 to a position aligned with media press member 34 of ADF part 20 and actuating media supply motor 81 and conveyance motor 83. Pickup roller 23 (FIG. 2) feeds document media 9 placed in media tray 11 to conveyance path 8. Media supply roller 24 and separation roller 25 separate one document medium 9 from document media 9 supplied by pickup roller 23, and feed document medium 9 to conveyance path 8. In operation mode M1, media supply sensor 27 detects passage of document medium 9, and overlap-feed sensor 28 detects overlap-feed of document media 9. In operation mode M1, when media supply sensor 27 detects passage of document medium 9, scan controller 75 controls the operation of clutch 82 based on the detection result, to thereby control the operations of pickup roller 23 and media supply roller 24. In operation mode M2, overlap-feed sensor 28 detects both passage of document medium 9 and overlap-feed of document media 9. In operation mode M2, when overlap-feed sensor 28 detects passage of document medium 9, scan controller 75 controls the operation of clutch 82 based on the detection result to thereby control the operations of pickup roller 23 and media supply roller 24. If overlap-feed sensor 28 detects overlap-feed of document media 9, scan controller 75 stops the operations of media supply motor 81 and conveyance motor 83, and instructs display 74 to display a message notifying the user of the overlap-feed.

Conveyance rollers 29 convey document medium 9 along conveyance path 8. Registration sensor 31 detects passage of document medium 9. Scan controller 75 controls the operation of clutch 84 based on a detection result from registration sensor 31 to thereby control the operation of registration rollers 32. Registration rollers 32 correct skew of document medium 9 passing registration rollers 32 along conveyance path 8. Scan start sensor 33 detects passage of document medium 9. Based on a detection result from scan start sensor 33, scan controller 75 determines the timing for imaging device 41 to start its scanning operation. Then, document medium 9 passes between transparent plate 42 and media press member 34. Imaging device 41 scans information printed on document medium 9 and generates scanned data DR. Scan controller 75 stores this scanned data DR in storage 89 temporarily. Scan controller 75 then supplies controller 77 with scanned data DR stored in storage 89. Discharge rollers 35 lead document medium 9, from which the information has been scanned, to media discharge part 13.

In a case where scanner part 40 operating as a flatbed scanner is used for the scanning of information printed on document medium 9, scan controller 75 (FIG. 10) moves imaging device 41 to a position aligned with the end portion of media press member 36 of ADF part 20. Then, scan controller 75 causes imaging device 41 to perform its scanning operation while moving slowing within the area covered by media press member 36. Imaging device 41 thus scans information printed on document medium 9 and generates scanned data DR. Scan controller 75 stores this scanned data DR in storage 89 temporarily. Scan controller 75 then supplies controller 77 with scanned data DR stored in storage 89.

Next, controller 77 (FIG. 9) instructs print controller 76 of image formation unit 50 to perform printing operation based on this scanned data DR.

In image formation unit 50, based on scanned data DR, print controller 76 controls the operations of the members of image formation unit 50 (FIG. 8), such as four exposure heads 69, four ID units 66, four transfer rollers 61, fuser part 65, and the various other rollers. Specifically, exposure head 69K and ID unit 66K form a toner image using black toner, exposure head 69Y and ID unit 66Y form a toner image using yellow toner, exposure head 69M and ID unit 66M forma toner image using magenta toner, and exposure head 69C and ID unit 66C form a toner image using cyan toner. Four transfer rollers 61 transfer the toner images generated on respective four photosensitive drums 67 onto recording medium 7. Then, fuser part 65 fuses and fixes the toner images onto recording medium 7. Recording medium 7 thus printed is discharged from image formation unit 50.

Details of the Operation of Overlap-Feed Sensor 28

As depicted in FIGS. 3 and 4, in ADF part 20, media supply sensor 27, the set of media supply roller 24 and separation roller 25, and overlap-feed sensor 28 are arranged in this order in the Y direction. Thus, when width W of document medium 9 is small, document medium 9 may not be sufficiently covered by the detection areas of media supply sensor 27 and overlap-feed sensor 28 when passing these sensors. For this reason, in ADF part 20, when width W of document medium 9 is smaller than predetermined width Wth, attachment 90 is attached to guide 12A as depicted in FIG. 4, so that document medium 9 placed on media tray 11 is pushed toward guide 12B. When width W of document medium 9 is thus smaller than predetermined width Wth, ADF part 20 operates under operation mode M2. In operation mode M2, overlap-feed sensor 28 detects both passage of document medium 9 and overlap-feed of document media 9.

In overlap-feed sensor 28, transmitter 28A transmits ultrasonic waves at a predetermined interval, and receiver 28B receives the ultrasonic waves transmitted by transmitter 28A. The amplitude of the ultrasonic waves received by receiver 28B varies depending on whether document medium 9 is, and how many document media 9 are, on conveyance path 8 between transmitter 28A and receiver 28B. Overlap-feed sensor 28 generates detection signal DET having a voltage corresponding to the amplitude of ultrasonic waves received by receiver 28B. Scan controller 75 controls the conveyance operation based on this detection signal DET.

Figure 11:
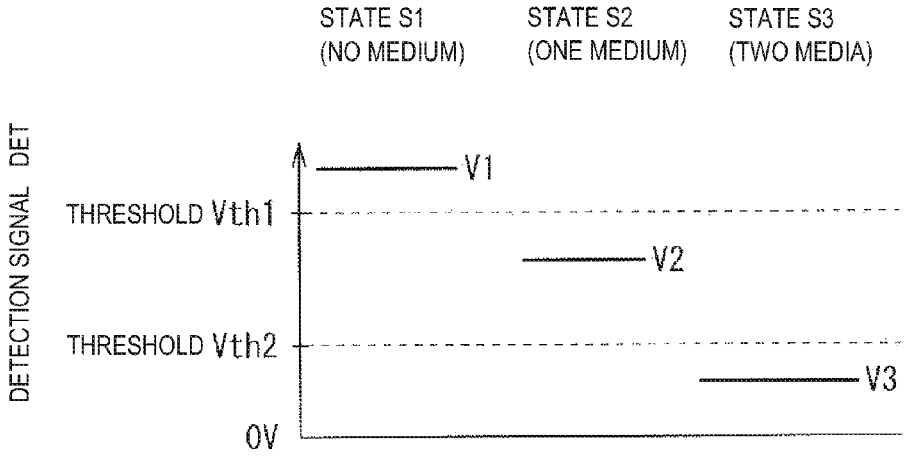
FIG. 11 is an explanatory diagram illustrating an example operation of an overlap-feed sensor depicted in FIG. 2.

FIG. 11 illustrates an example operation of overlap-feed sensor 28. In particular, FIG. 11 depicts voltages for detection signals DET in three states S1 to S3. In state S1, there is no document medium 9 on conveyance path 8 between transmitter 28A and receiver 28B. In state S2, there is one document medium 9 on conveyance path 8 between transmitter 28A and receiver 28B. In state S3, there are two document media 9 on conveyance path 8 between transmitter 28A and receiver 28B.

In State S1, the voltage of detection signal DET is voltage V1. Voltage V1 is, for example, about 2.9 V. In state S1, the amplitude of ultrasonic waves received by receiver 28B is large because there is no document medium 9 on conveyance path 8 between transmitter 28A and receiver 28B. Thus, the voltage of detection signal DET in state S1 is voltage V1 which is high.

In State S2, the voltage of detection signal DET is voltage V2, which is lower than voltage V1. Voltage V2 is, for example, about 2 V. In state S2, the amplitude of ultrasonic waves received by receiver 28B is smaller than that in state S1 because there is one document medium 9 on conveyance path 8 between transmitter 28A and receiver 28B. Thus, the voltage of detection signal DET in state S2 is voltage V2, which is lower than voltage V1.

In State S3, the voltage of detection signal DET is voltage V3, which is lower than voltage V2. Voltage V3 is, for example, about 0.7 V. In state S3, the amplitude of ultrasonic waves received by receiver 28B is even smaller than that in state S2 because there are two document media 9 on conveyance path 8 between transmitter 28A and receiver 28B. Thus, the voltage of detection signal DET in state S3 is voltage V3, which is lower than voltage V2. If there are more than two document media 9 on conveyance path 8 between transmitter 28A and receiver 28B, the voltage of detection signal DET is even lower than voltage V3.

Based on such detection signal DET, scan controller 75 detects both passage of document medium 9 and overlap-feed of document media 9. Specifically, as depicted in FIG. 11, scan controller 75 compares the voltage of detection signal DET with threshold Vth1 and threshold Vth2 to detect both passage of document medium 9 and overlap-feed of document media 9. Threshold Vth1 is used to distinguish between state S1 and state S2, and is set to a voltage between voltage V1 and voltage V2. Threshold Vth1 may be, for example, 2.5 V. Threshold Vth2 is used to distinguish between state S2 and State S3, and is set to a voltage between voltage V2 and voltage V3. Threshold Vth2 may be, for example, 0.8 V.

In this example, scan controller 75 determines that document medium 9 is passing overlap-feed sensor 28 when the voltage of detection signal DET is lower than threshold Vth1. Specifically, when the voltage of detection signal DET is lower than threshold Vth1 and higher than threshold Vth2, scan controller 75 determines that one document medium 9 is passing overlap-feed sensor 28. When the voltage of detection signal DET is lower than threshold Vth2, scan controller 75 determines that overlap-feed is occurring.

Figure 12:
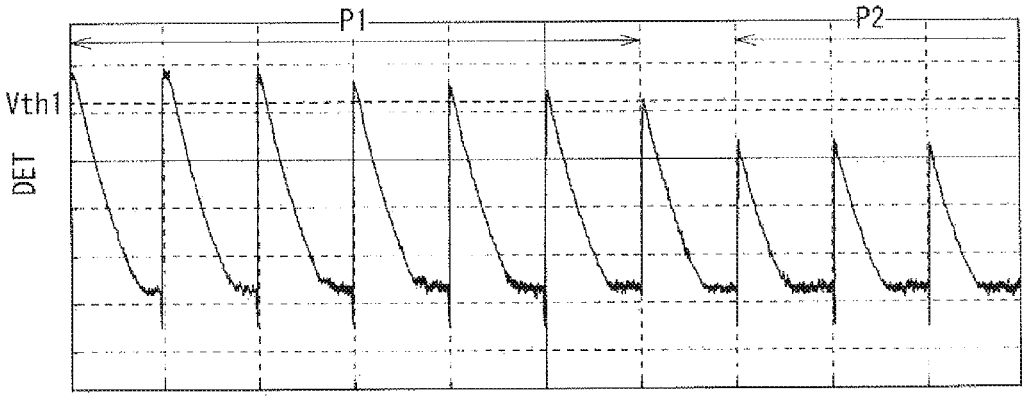
FIG. 12 is a waveform diagram illustrating an example operation of the overlap-feed sensor depicted in FIG. 2.

FIG. 12 illustrates an example of how the waveform of detection signal DET appears when document medium 9 is being conveyed. In this example, transmitter 28A transmits ultrasonic waves at, for example, 10-millisecond (ms) intervals. Accordingly, detection signal DET changes at the same intervals as the transmission intervals. In this example, in period P1, document medium 9 has yet to reach overlap-feed sensor 28. Thus, the peak voltage of detection signal DET is higher than threshold Vth1. In period P2, one document medium 9 reaches and passes overlap-feed sensor 28. Thus, the peak voltage of detection signal DET is lower than threshold Vth1. By thus comparing the voltage of detection signal DET with threshold Vth1, document medium 9 can detect passage of document medium 9.

As described above, transmitter 28A transmits ultrasonic waves at a predetermined interval. Thus, when overlap-feed sensor 28 detects the leading edge and tailing edge of document medium 9 in operation mode M2, the detection timing contains error based on this interval. In a case where the interval is 10 ms and the speed at which document medium 9 is conveyed is 250 mm/second, the detection-timing error produces a conveyance error of up to 2.5 mm. In addition, since overlap-feed sensor 28 uses ultrasonic waves to detect document medium 9, a detection result on the position of document medium 9 contains an error of, for example, about 5 mm. If the interval between document media 9 (document interval) becomes too small when multiple document media 9 are conveyed one by one, ADF part 20 determines that paper jam has occurred. Thus, the document interval needs to be increased by 7.5 mm (=2.5+5). Such increase in the document interval may lower throughput.

FIG. 13 illustrates an example of throughput characteristics of ADF part 20 operated under operation mode M1 and operation mode M2. In this example, the document interval is 80 mm in operation mode M1 and 87.5 mm (=80+7.5) in operation mode M2. In this example, for media of size "A6" and orientation "portrait", throughput is 65.6 scan per minute (spm) in operation mode M1 and 63.6 spm in operation mode M2. For media of size "A3", throughput is 30.0 spm in operation mode M1 and 29.6 spm in operation mode M2. As these figures indicate, throughput decreases in operation mode M2, but to a small extent.

As described above, in ADF part 20, overlap-feed sensor 28 is used in operation mode M2 to detect passage of document medium 9. If registration sensor 31 is used in operation mode M2 instead to detect passage of document medium 9, throughput may decrease even more. Registration sensor 31 is, as depicted in FIG. 2, disposed downstream of overlap-feed sensor 28 on conveyance path 8. Hence, controlling pickup roller 23 and media supply roller 24 based on a detection result from registration sensor 31 increases the document interval, and therefore, lowers throughput. For instance, in ADF part 20R (comparative example) the document interval of which is 220 [mm], throughput for media of size "A6" and orientation "portrait" is decreased to as low as 40.7 spm.

On the other hand, ADF part 20 according to the embodiment uses overlap-feed sensor 28, which is disposed near pickup roller 23 and media supply roller 24, to detect passage of document medium 9 in operation mode M2; hence, throughput decrease can be mitigated.

Advantageous Effects

As described above, in the embodiment, the media supply sensor, the set of the media supply roller and the separation roller, and the overlap-feed sensor are arranged in this order in the Y direction which intersects the conveyance direction along the conveyance path. This enables reduction in apparatus size.

In the embodiment, detection signals from the overlap-feed sensor are compared with two thresholds in operation mode M2. Thus, the overlap-feed sensor can detect both passage and overlap-feed of document media. This eliminates the need of using the media supply sensor in operation mode M2, and hence enables conveyance of a document medium with small width.

In the embodiment, the attachment is attached in operation mode M2, enabling stable conveyance of a document medium even when the document medium has small width. Moreover, since the attachment is attached to one of the guides which is closer to the operation part and the display, it is easy for a user to attach the attachment.

Modification 1

In the embodiment described above, guide 12A is provided with attachment sensor 19 as depicted in FIG. 6 to detect attachment of attachment 90. However, the invention is not limited to this. For example, instead of such a configuration, attachment sensor 19 may be omitted.

Modification 2

Figure 14A:
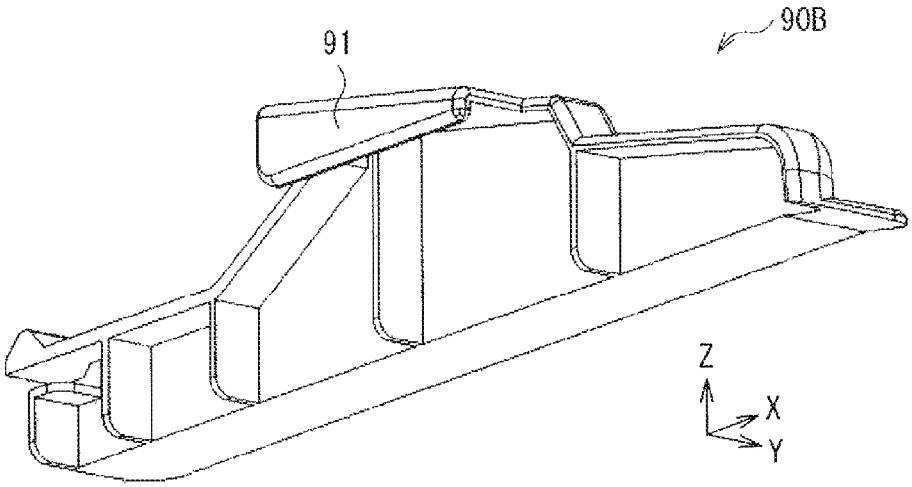
FIG. 14A is a perspective view illustrating an example configuration of an attachment according to a modification.
Figure 14B:
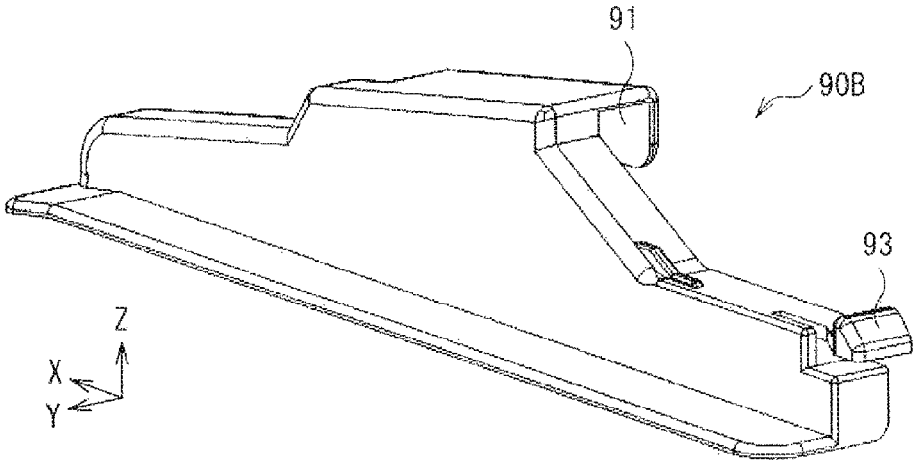
FIG. 14B is another perspective view illustrating the example configuration of the attachment according to the modification.
Figure 15:
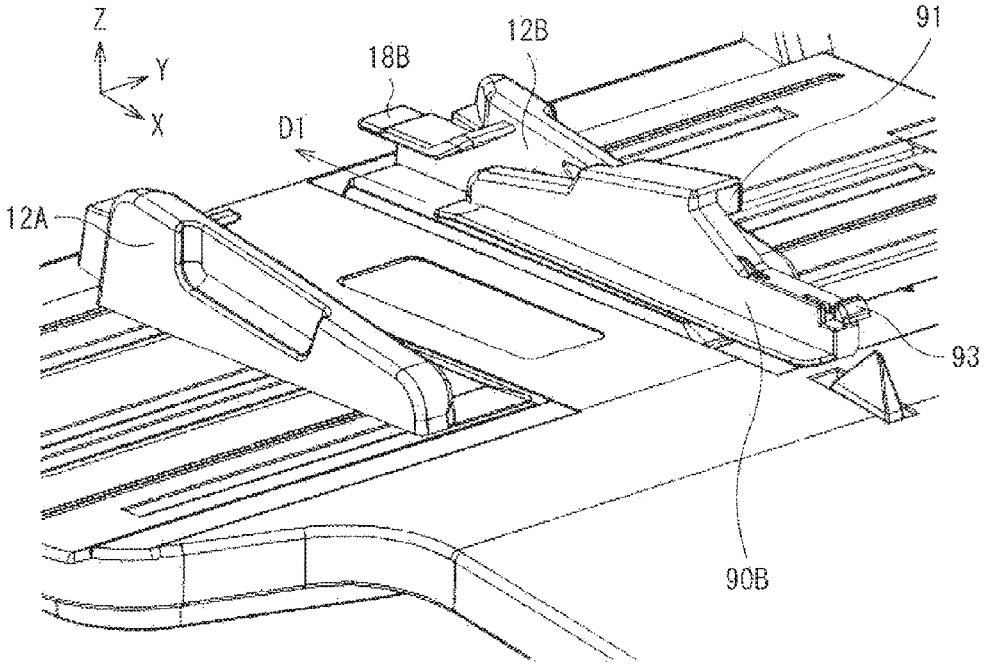
FIG. 15 is a perspective view illustrating an example of how the attachment depicted in FIGS. 14A and 14B is attached.
Figure 16:
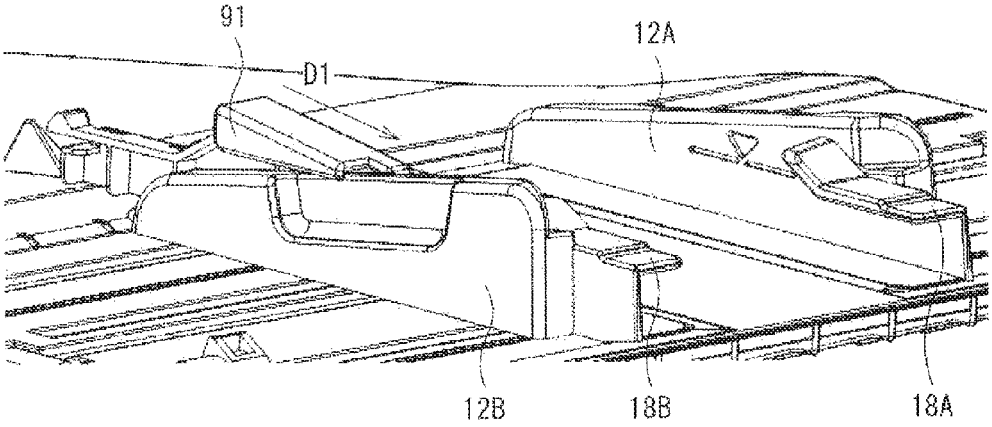
FIG. 16 is another perspective view illustrating the example of how the attachment depicted in FIGS. 14A and 14B is attached.

In the embodiment described above, attachment 90 is provided with protrusion portion 92. However, the invention is not limited to this. Instead of such a configuration, protrusion portion 92 may be omitted like attachment 90B depicted in FIGS. 14A and 14B. With such a configuration, attachment 90B can still be prevented from being attached to guide 12B by mistake, as depicted in FIGS. 15 and 16. Specifically, like attachment 90 (FIGS. 5A and 5B), the surface of engagement portion 91 of attachment 90B which comes into contact with guide 12A is slanted to coincide with the slant of guide 12A. The upper surface of guide 12B is slanted like that of guide 12A. Thus, as depicted in FIGS. 15 and 16, even if attachment 90B is slid in slide direction D1, engagement portion 91 of attachment 90B does not engage with guide 12B because the slant of attachment 90B does not coincide with the slant of guide 12B. In addition, since fixation portion 93 is situated on the opposite side from presser 18B of guide 12B as depicted in FIG. 15, attachment 90B is not fixed to guide 12B. This configuration also prevents attachment 90B from being attached to guide 12B by mistake.

Modification 3

In the embodiment described above, when document medium 9 has a non-standard size, a user directly inputs width W of document medium 9 using operation part 73 or a user interface of the host computer. However, the invention is not limited to this. For example, if multi-function peripheral 1 is configured to allow shortcuts to be set therein, a shortcut may be used to indirectly input width W of document medium 9. Specifically, for example, a user sets a shortcut of an operation of scanning information on document medium 9 in advance. In this shortcut, the size of document medium 9 (such as, for example, width W) is set, too. Then by selecting this shortcut, the user instructs multi-function peripheral 1 to scan information on document medium 9.

The invention has been described thus far using the embodiment and modifications, but the invention is not limited to these and can be variously modified.

For example, although the invention is applied to ADF part 20 of multi-function peripheral 1 in the embodiment and modifications described above, the invention is not limited to this. Instead, the invention may be applied to, for example, image formation unit 50 as a technique for conveying recording medium 7 along conveyance path 6. In this case, image formation unit 50 is a specific example of the "media conveyance apparatus" of the present disclosure. The invention may be applied to both ADF part 20 and image formation unit 50 of multi-function peripheral 1. In this case, multi-function peripheral 1 is a specific example of the "media conveyance apparatus" of the present disclosure.

Further, although the invention is applied to multi-function peripheral 1 in the embodiment and the like described above, the invention is not limited to this. Instead, the invention may be applied to an image scan apparatus (scanner) with ADF function. Still alternatively, the invention may be applied to an image formation apparatus, a copier, or a facsimile machine. In such cases, these apparatuses are each a specific example of the "media conveyance apparatus" of the present disclosure.

Furthermore, although image formation unit 50 can form color images in the embodiment and the like described above, the invention is not limited to this. Instead, image formation unit 50 may be capable of forming monochrome images, for example.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A media conveyance apparatus comprising:

a first conveyer configured to convey media along a conveyance path;

a first detector configured to detect single-feed and overlap-feed of the media conveyed by the first conveyer;

a second detector configured to detect the media conveyed by the first conveyer; and a controller programmed to:

select a first operation mode when a width of the media in a widthwise direction orthogonal to a conveyance direction along the conveyance path is greater than or equal to a predetermined width;

select a second operation mode when the width of the media in the widthwise direction is smaller than the predetermined width;

control operation of the first conveyer using the first detector to detect overlap-feed of the media and the second detector to detect passage of the media in the first operation mode;

control operation of the first conveyer using the first detector to detect passage of the media and to detect overlap-feed of the media in the second operation mode; and determine if overlap-feed of the media occurs based on a detection value from the first detector, a first threshold for detection of single-feed of the media, and a second threshold for detection of overlap-feed of the media.

2. The media conveyance apparatus according to claim 1, further comprising an operation part configured to receive an user input, wherein the controller selects the second operation mode based on the input received by the operation part.

3. The media conveyance apparatus according to claim 1, wherein the controller selects the second operation mode based on an instruction from the outside.

4. The media conveyance apparatus according to claim 1, further comprising:

a placement part that is disposed upstream of the first conveyer along the conveyance path, and on which the media to be conveyed is to be placed;

a first restrict member and a second restrict member facing each other in the widthwise direction orthogonal to the conveyance direction extending along the conveyance path and slidably supported on the placement part to change an opposing distance between the first restrict member and the second restrict member and to restrict a position of the media; and a third detector configured to detect whether the opposing distance is shorter than a predetermined distance, wherein the controller selects the second operation mode based on a detection result from the third detector.

5. The media conveyance apparatus according to claim 1, wherein based on a reference value which is a value detected by the first detector when no media is present at the first detector wherein the reference value is greater than the first threshold which is greater than the second threshold, the controller detects single-feed of the media when the detection value is between the first threshold and the second threshold, and detects overlap-feed of the media when the detection value falls below the second threshold.

6. The media conveyance apparatus according to claim 1, further comprising:

a second conveyer disposed downstream of the first conveyer along the conveyance path, and configured to convey the media along the conveyance path, wherein the first detector, the second conveyer, and the second detector are arranged in that order in the widthwise direction orthogonal to the conveyance direction extending along the conveyance path.

7. The media conveyance apparatus according to claim 6, further comprising:

a placement part that is disposed upstream of the first conveyer along the conveyance path, and on which the media to be conveyed is to be placed thereon;

a first restrict member and a second restrict member facing each other in the widthwise direction, and configured to restrict a position of the media; and a third restrict member configured to be detachably attached to the first restrict member, and to restrict the position of the media between the second restrict member and the third restrict member when attached to the first restrict member, wherein the second restrict member, the third restrict member and the first restrict member are arranged in that order in the widthwise direction.

8. The media conveyance apparatus according to claim 1, wherein in the widthwise direction orthogonal to the conveyance direction along the conveyance path, a first distance between the first detector and a widthwise center of the conveyance path is smaller than a second distance between the second detector and the widthwise center of the conveyance path.

9. The media conveyance apparatus according to claim 8, wherein the first detector and the second detector are overlapped at least partially with each other along the widthwise direction.

10. The media conveyance apparatus according to claim 1, wherein the first detector includes a transmitter and a receiver facing each other with the conveyance path between the transmitter and the receiver, wherein the transmitter is configured to transmit ultrasonic waves at predetermined intervals toward the receiver.

11. The media conveyance apparatus according to claim 1, wherein the controller controls the first conveyer to convey the media such that the first conveyer conveys the media at first intervals in the first operation mode and conveys the media at second intervals in the second operation mode, wherein the first intervals is less than the second intervals.

12. The media conveyance apparatus according to claim 1, wherein the controller stops the operation of the first conveyer when it is determined that overlap-feed of the media occurs.

13. A media conveyance apparatus comprising:

a first conveyer configured to convey media along a conveyance path;

a first detector configured to detect single-feed and overlap-feed of the media conveyed by the first conveyer;

a controller programmed to control operation of the first conveyer based on a detection value from the first detector, a first threshold for detection of single-feed of the media, and a second threshold for detection of overlap-feed of the media;

a second detector configured to detect the media conveyed by the first conveyer;

a second conveyer disposed downstream of the first conveyer along the conveyance path, and configured to convey the media along the conveyance path, wherein the first detector, the second conveyer, and the second detector are arranged in that order in a widthwise direction orthogonal to a conveyance direction extending along the conveyance path;

a placement part that is disposed upstream of the first conveyer along the conveyance path, and on which the media to be conveyed is to be placed thereon;

a first restrict member and a second restrict member facing each other in the widthwise direction, and configured to restrict a position of the media; and a third restrict member configured to be detachably attached to the first restrict member, and to restrict the position of the media between the second restrict member and the third restrict member when attached to the first restrict member, wherein the second restrict member, the third restrict member and the first restrict member are arranged in that order in the widthwise direction.

14. The media conveyance apparatus according to claim 13, wherein the third restrict member includes an engagement portion that engages with the first restrict member such that the third restrict member is attached to the first restrict member, and an engagement prevention portion that prevents the engagement portion from engaging with the second restrict member thereby preventing the third restrict member from being attached to the second restrict member.

15. The media conveyance apparatus according to claim 14, wherein the engagement portion engages with the first restrict member when the third restrict member is slid onto the first restrict member in the conveyance direction, and the engagement prevention portion prevents the third restrict member from being slid onto the second restrict member in the conveyance direction.

16. The media conveyance apparatus according to claim 15, wherein the third restrict member includes a fixation portion provided at a predetermined position on the third restrict member and configured to fix the third restrict member to the first restrict member when the engagement portion engages with the first restrict member.

17. The media conveyance apparatus according to claim 13, wherein the third restrict member includes an engagement portion that engages with the first restrict member when the third restrict member is slid onto the first restrict member in the conveyance direction, and that prevents the third restrict member from engaging with the second restrict member when the third restrict member is slid onto the second restrict member in the conveyance direction.

18. The media conveyance apparatus according to claim 13, further comprising an operation part that receives a user input, wherein the second restrict member, the first restrict member, and the operation part are arranged in that order in the widthwise direction.

* * * * *